US011674511B2

(12) United States Patent
Liu et al.

(10) Patent No.: US 11,674,511 B2
(45) Date of Patent: Jun. 13, 2023

(54) HUB OF MOVABLE SCROLL DEVICE FOR SCROLL COMPRESSOR INCLUDING CENTROID-ADJUSTING RECESS AND METHOD FOR MANUFACTURING SAME

(71) Applicant: EMERSON CLIMATE TECHNOLOGIES (SUZHOU) CO., LTD., Jiangsu (CN)

(72) Inventors: Xuan Liu, Jiangsu (CN); Jing Huang, Jiangsu (CN)

(73) Assignee: Emerson Climate Technologies (Suzhou) Co., Ltd., Jiangsu (CN)

( * ) Notice: Subject to any disclaimer, the term of this patent is extended or adjusted under 35 U.S.C. 154(b) by 214 days.

(21) Appl. No.: 16/649,024

(22) PCT Filed: Sep. 19, 2018

(86) PCT No.: PCT/CN2018/106418
§ 371 (c)(1),
(2) Date: Mar. 19, 2020

(87) PCT Pub. No.: WO2019/057056
PCT Pub. Date: Mar. 28, 2019

(65) Prior Publication Data

US 2020/0291941 A1 Sep. 17, 2020

(30) Foreign Application Priority Data

Sep. 19, 2017 (CN) ..... 201710851858.2
Sep. 19, 2017 (CN) ..... 201721210668.4

(51) Int. Cl.
*F04C 18/02* (2006.01)
*F04C 23/00* (2006.01)

(52) U.S. Cl.
CPC ..... *F04C 18/0246* (2013.01); *F04C 18/0253* (2013.01); *F04C 18/0215* (2013.01);
(Continued)

(58) Field of Classification Search
CPC ..... F04C 18/0246; F04C 18/0253; F04C 18/0215; F04C 23/008; F04C 2230/10; F04C 2230/21
See application file for complete search history.

(56) References Cited

U.S. PATENT DOCUMENTS 5,127,809 A 7/1992 Amata et al.
6,139,294 A * 10/2000 Haller ..... F04C 18/0215 418/57
(Continued)

FOREIGN PATENT DOCUMENTS

CN 1804400 A 7/2006
CN 102650289 A 8/2012
(Continued)

OTHER PUBLICATIONS

English Machine Translation of JP2017-198133A (Year: 2017).*
(Continued)

*Primary Examiner* — Dominick L Plakkoottam
*Assistant Examiner* — Paul W Thiede
(74) *Attorney, Agent, or Firm* — Hamess, Dickey & Pierce, P.L.C.

(57) ABSTRACT

Disclosed are a movable scroll device for a scroll compressor and a method for manufacturing same. The method includes: manufacturing the movable scroll device by means of casting steps, so that the movable scroll device includes a movable scroll end plate, with a movable scroll blade provided on a first side face of the movable scroll end plate; and a hub vertically extending outwards from the middle of a second side face of the movable scroll end plate; and
(Continued)

fabricating at least one centroid adjustment recess on the hub. By the method, the centroid of the movable scroll device can be adjusted in a more flexible, precise, active and targeted manner.

19 Claims, 13 Drawing Sheets

(52) U.S. Cl.
CPC ..... *F04C 23/008* (2013.01); *F04C 2230/10* (2013.01); *F04C 2230/21* (2013.01)

(56) References Cited

U.S. PATENT DOCUMENTS 6,494,695 B1 12/2002 Lifson
7,217,109 B2 5/2007 Takei
8,157,553 B2 * 4/2012 Yamazaki ..... F04C 18/0215 418/150
10,233,927 B2 3/2019 Wang et al.
2003/0152472 A1 * 8/2003 Kiem ..... F04C 29/0057 418/55.6
2006/0171830 A1 8/2006 Takei
2010/0061871 A1 * 3/2010 Arai ..... F04C 23/008 420/13
2013/0251567 A1 9/2013 Wang et al.

FOREIGN PATENT DOCUMENTS

CN 104302919 A 1/2015
CN 207377800 U 5/2018
JP 2017198133 A * 11/2017

OTHER PUBLICATIONS

International Search Report (in English and Chinese) and Written Opinion of the International Searching Authority (in Chinese) issued in PCT/CN2018/106418, dated Dec. 25, 2018; ISA/CN.

* cited by examiner

HUB OF MOVABLE SCROLL DEVICE FOR SCROLL COMPRESSOR INCLUDING CENTROID-ADJUSTING RECESS AND METHOD FOR MANUFACTURING SAME

This application is the national phase of International Application No. PCT/CN2018/106418, titled "MOVABLE SCROLL DEVICE FOR SCROLL COMPRESSOR AND METHOD FOR MANUFACTURING SAME, AND SCROLL COMPRESSOR" and filed on Sep. 19, 2018, which claims priorities to Chinese Patent Application No. 201710851858.2 titled "MOVABLE SCROLL DEVICE FOR SCROLL COMPRESSOR AND METHOD FOR MANUFACTURING SAME, AND SCROLL COMPRESSOR" and filed with the Chinese National Intellectual Property Administration on Sep. 19, 2017, and to Chinese Patent Application No. 201721210668.4 titled "MOVABLE SCROLL DEVICE FOR SCROLL COMPRESSOR AND SCROLL COMPRESSOR INCLUDING SAME" and filed with the Chinese National Intellectual Property Administration on Sep. 19, 2017. The entire disclosures of the two patent applications are incorporated herein by reference.

FIELD

The present application relates to the field of an orbiting scroll apparatus for a scroll compressor, a manufacturing method thereof, and a scroll compressor.

BACKGROUND

This section only provides background information relating to the present application, which may not necessarily constitute the prior art.

A scroll compressor is a compressor with a wide range of applications. A core component of the scroll compressor is a scroll compression assembly. The scroll compression assembly is mainly composed of an orbiting scroll apparatus and a stationary scroll apparatus. An orbiting scroll end plate of the orbiting scroll apparatus is provided with an orbiting scroll vane displaced from the center of the orbiting scroll end plate (that is, the central axis of a drive bearing of the compressor), and a stationary scroll end plate of the stationary scroll apparatus is provided with a stationary scroll vane displaced from the center of the stationary scroll end plate (that is, the center axis of the drive bearing of the compressor). During the operation of the compressor, the stationary scroll apparatus remains stationary in a radial direction, and the orbiting scroll apparatus performs, driven by a drive motor through the drive bearing, a circular translational movement relative to the stationary scroll apparatus, so that the orbiting scroll vane on the orbiting scroll end plate and the stationary scroll vane on the stationary scroll end plate engage with each other and perform compression along with the circular translational motion.

Since the orbiting scroll vane on the orbiting scroll end plate of the orbiting scroll apparatus is asymmetric, it is difficult to precisely align the centroid of the orbiting scroll apparatus originally cast to the center axis of the drive bearing of the compressor. Such an eccentricity of the centroid may cause an unbalanced centrifugal force and an unbalanced centrifugal moment during the circular translational movement, thereby increasing the noise or reducing efficiency of the entire orbiting scroll apparatus during operation. In addition, in a case that the same casted orbiting scroll apparatus is desired to be applied to different compressor platforms, in order to meet specific noise or efficiency requirements, the centroid of the orbiting scroll apparatus is desired to be adjustable.

However, in the prior art, the centroid of the orbiting scroll apparatus is accurately determined by accurately designing the casting mold, which is very costly. In addition, in a case that it is required to adjust the centroid of the orbiting scroll apparatus when the orbiting scroll apparatus is applied to different compressor platforms, it is also necessary to redesign the mold, which results in higher costs.

SUMMARY

An object of the present application is to solve one or more of the above technical problems. In general, according to the present application, the flexible adjustment of the centroid of the orbiting scroll apparatus is achieved by simply on-site machining such as drilling and slotting to remove the material at specific positions on a hub of the orbiting scroll apparatus.

According to a first aspect of the present application, an orbiting scroll apparatus for a scroll compressor is provided, which includes: an orbiting scroll end plate; an orbiting scroll vane formed on a first side surface of the orbiting scroll end plate; and a hub extending outward from a substantially central region of a second side surface of the orbiting scroll end plate opposite to the first side surface and having a cylindrical opening configured to receive a drive bearing, and wherein the hub is provided with at least one centroid-adjusting recess.

Preferably, the at least one centroid-adjusting recess is provided on a surface of the hub in such a manner that the engagement between the hub and the drive bearing and the normal operation of the orbiting scroll apparatus are not affected.

That is, the at least one centroid-adjusting recess of the orbiting scroll apparatus for a scroll compressor according to the present application may be provided at any position on any surface of the hub by machining. Therefore, after the casting of the orbiting scroll apparatus, the centroid adjustment can be performed according to factors such as the eccentricity of the centroid of the orbiting scroll apparatus, the direction of eccentricity, the environment in the compressor, and the requirements of dynamic balance.

Preferably, the hub includes a first cylindrical portion and a second cylindrical portion, the first cylindrical portion integrally and vertically extends from the orbiting scroll end plate, an outer diameter of the second cylindrical portion is larger than the outer diameter of the first cylindrical portion, and the second cylindrical portion extends vertically from one end of the first cylindrical portion while the second cylindrical portion is concentric and integral with the first cylindrical portion.

Preferably, the at least one centroid-adjusting recess is provided on the second cylindrical portion of the hub.

Preferably, the at least one centroid-adjusting recess is provided on an outer circumferential surface of the second cylindrical portion.

Preferably, the at least one centroid-adjusting recess includes at least two centroid-adjusting recesses provided at different positions, and the at least two centroid-adjusting recesses have different shapes and/or sizes.

Preferably, the at least one centroid-adjusting recess includes at least one hole and/or at least one groove.

Preferably, the at least one hole includes at least two holes provided at different positions, and the at least two holes have different diameters and/or depths.

Preferably, the at least one groove includes at least two grooves provided at different positions, the at least two grooves have different lengths and/or opening widths and/or depths, and the at least two grooves extend circumferentially or axially. It should be noted that the groove is arranged, extending circumferentially or axially, to facilitate machining, that is, if the groove is arranged to extend circumferentially, the groove can be easily processed by turning, and if the groove is arranged to extend axially, the groove can be easily processed by planning. However, the groove is not limited to the above-mentioned extending direction and processing methods, but may extend in any other direction and be processed by any other suitable method in the art.

Preferably, each of the at least one groove extends along an outer surface of the hub and along a circumferential direction of the second cylindrical portion with a constant opening width and/or a constant depth to form a ring shape.

Preferably, each of the at least one groove extends along an outer surface of the hub and along a circumferential direction of the second cylindrical portion with a varying opening width and/or a varying depth to form a ring shape.

In other words, centroid-adjusting recesses of different types or shapes (such as holes and/or grooves) and different sizes (such as different hole diameters and/or depths, different lengths and/or opening widths and/or depths) can be formed at different positions according to factors such as the eccentricity of the centroid of the orbiting scroll apparatus, the direction of eccentricity, the environment in the compressor, and the requirements of dynamic balance, so as to more flexibly and accurately adjust the centroid of the orbiting scroll apparatus to the center of the drive bearing of the compressor.

Preferably, the at least one hole and the at least one groove at least partially overlap each other.

Preferably, the at least one centroid-adjusting recess is formed by machining.

Preferably, the machining includes at least one of drilling, turning, and milling.

According to a second aspect of the present application, a scroll compressor including the above orbiting scroll apparatus for the scroll compressor is provided.

According to a third aspect of the present application, a method for manufacturing the orbiting scroll apparatus for the scroll compressor is provided, which includes the following steps:

casting the orbiting scroll apparatus so that the orbiting scroll apparatus includes: an orbiting scroll end plate; an orbiting scroll vane formed on a first side surface of the orbiting scroll end plate; a hub extending outward from a substantially central region of a second side surface of the orbiting scroll end plate opposite to the first side surface and having a cylindrical opening configured to receive a drive bearing; and providing at least one centroid-adjusting recess on the hub to adjust the centroid of the orbiting scroll apparatus to the center axis of the drive bearing.

Preferably, the hub includes a first cylindrical portion and a second cylindrical portion, the first cylindrical portion integrally and vertically extends from the orbiting scroll end plate, an outer diameter of the second cylindrical portion is larger than the outer diameter of the first cylindrical portion, the second cylindrical portion extends vertically from one end of the first cylindrical portion while the second cylindrical portion is concentric and integral with the first cylindrical portion, and the at least one centroid-adjusting recess is provided on an outer circumferential surface of the second cylindrical portion.

Preferably, the at least one centroid-adjusting recess includes at least two centroid-adjusting recesses provided at different positions, and the at least two centroid-adjusting recesses have different shapes and/or sizes.

Preferably, the at least one centroid-adjusting recess includes at least one hole and/or at least one groove.

Preferably, the at least one centroid-adjusting recess is formed by machining.

Preferably, the machining includes at least one of drilling, turning, and milling.

Compared with the prior art, according to the method for manufacturing the orbiting scroll apparatus for the scroll compressor of the present application, a machining method instead of a cast-forming method is adopted to form at least one centroid-adjusting recess on the hub. The at least one centroid-adjusting recess may be provided at any position on any surface of the hub by machining. Moreover, after the casting of the orbiting scroll apparatus, the at least one centroid-adjusting recess is processed into centroid-adjusting recesses of different types or shapes (such as holes and/or grooves) and different sizes (such as different hole diameters and/or depths, different lengths and/or opening widths and/or depths) according to factors such as the eccentricity of the centroid of the orbiting scroll apparatus, the direction of eccentricity, the environment in the compressor, and the requirements of dynamic balance, so as to more flexibly and accurately adjust the centroid of the orbiting scroll apparatus to the center of the drive bearing of the compressor. Therefore, compared with the prior art, the method according to the present application has more flexibility, initiative, and pertinence in adjusting the centroid.

The orbiting scroll apparatus for the scroll compressor and the scroll compressor manufactured by the method for manufacturing the orbiting scroll apparatus for the scroll compressor according to the present application have the following advantages: After the casting of the orbiting scroll apparatus, in a case that the same casted orbiting scroll apparatus is desired to be applied to different compressor platforms, the centroid-adjusting recess with a simple shape is processed by a simple machining process according to factors such as the eccentricity of the centroid of the orbiting scroll apparatus, the direction of eccentricity, the environment in the compressor, and the requirements of dynamic balance, so as to achieve more flexible, accurate, initiative and targeted adjustment of the centroid of the orbiting scroll apparatus to meet the specific noise or efficiency requirements of the compressor. That is, the present application provides a novel idea and concept in adjusting the centroid of the orbiting scroll apparatus. Furthermore, the orbiting scroll apparatus for the scroll compressor and the scroll compressor manufactured according to the present application have lower costs, and, the machining processes thereof are simpler and easy to implement, and have universal applicability.

BRIEF DESCRIPTION OF THE DRAWINGS

The foregoing and additional features and characteristics of the present application will become more apparent from the following detailed description with reference to the accompanying drawings, which are merely examples and are not necessarily drawn to scale. The same reference numbers are used in the drawings to indicate the same components, and in the drawings:

FIGS. 1A, 1B, 1C and 1D show an orbiting scroll apparatus for a scroll compressor in the related technology, wherein FIG. 1A shows a perspective view of the orbiting scroll apparatus, FIG. 1B shows a side view of the orbiting scroll apparatus, FIG. 1C shows a cross-sectional view of the orbiting scroll apparatus taken along the section line I-I in FIG. 1B, and FIG. 1D shows a longitudinal sectional view of the orbiting scroll apparatus taken along the section line II-II in FIG. 1C;

FIGS. 2A, 2B, 2C and 2D show an orbiting scroll apparatus for a scroll compressor according to a first embodiment of the present application, wherein FIG. 2A shows a perspective view of the orbiting scroll apparatus, FIG. 2B shows a side view of the orbiting scroll apparatus, FIG. 2C shows a cross-sectional view of the orbiting scroll apparatus taken along the section line I-I in FIG. 2B, and FIG. 2D shows a longitudinal sectional view of the orbiting scroll apparatus taken along the section line II-II in FIG. 2C;

FIGS. 3A, 3B, 3C and 3D show the orbiting scroll apparatus for a scroll compressor according to a second embodiment of the present application, wherein FIG. 3A shows a perspective view of the orbiting scroll apparatus, FIG. 3B shows a side view of the orbiting scroll apparatus, FIG. 3C shows a cross-sectional view of the orbiting scroll apparatus taken along the section line I-I in FIG. 3B, and FIG. 3D shows a longitudinal sectional view of the orbiting scroll apparatus taken along the section line II-II in FIG. 3C;

FIGS. 4A, 4B, 4C and 4D show the orbiting scroll apparatus for a scroll compressor according to a third embodiment of the present application, wherein FIG. 4A shows a perspective view of the orbiting scroll apparatus, FIG. 4B shows a side view of the orbiting scroll apparatus, FIG. 4C shows a cross-sectional view of the orbiting scroll apparatus taken along the section line I-I in FIG. 4B, and FIG. 4D shows a longitudinal sectional view of the orbiting scroll apparatus taken along the section line II-II in FIG. 4C;

FIGS. 5A, 5B, 5C and 5D show the orbiting scroll apparatus for a scroll compressor according to a fourth embodiment of the present application, wherein FIG. 5A shows a perspective view of the orbiting scroll apparatus, FIG. 5B shows a side view of the orbiting scroll apparatus, FIG. 5C shows a cross-sectional view of the orbiting scroll apparatus taken along the section line I-I in FIG. 5B, and FIG. 5D shows a longitudinal sectional view of the orbiting scroll apparatus taken along the section line II-II in FIG. 5C;

Figure 1A:
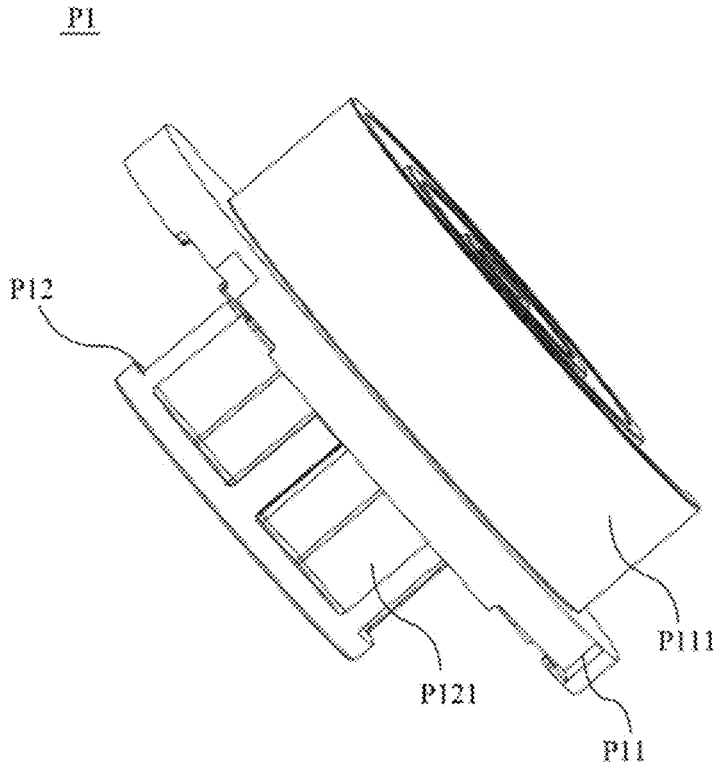
Figure 1A PRIOR ART

Reference numerals are listed as follows:

the present application will be described in detail with reference to the accompanying drawings, compared with the orbiting scroll apparatus P1 in the related technology. The following description is merely exemplary in nature and is not intended to limit the present disclosure and an application or use thereof.

Figure 1B:
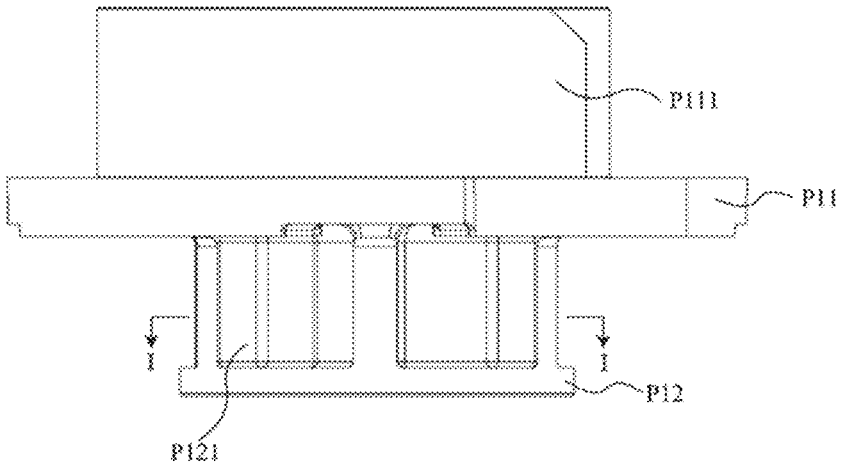
Figure 1B PRIOR ART
Figure 1C:
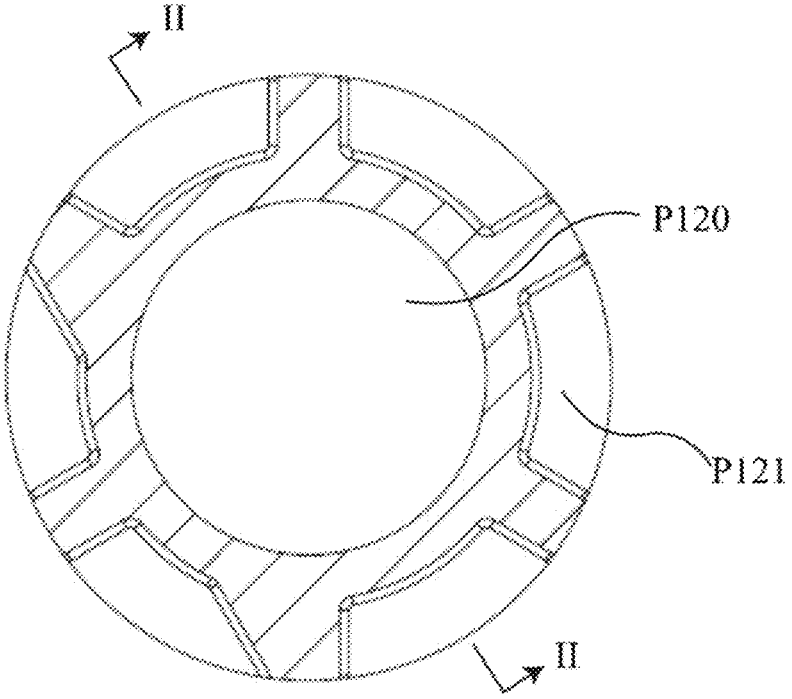
Figure 1C PRIOR ART
Figure 1D:
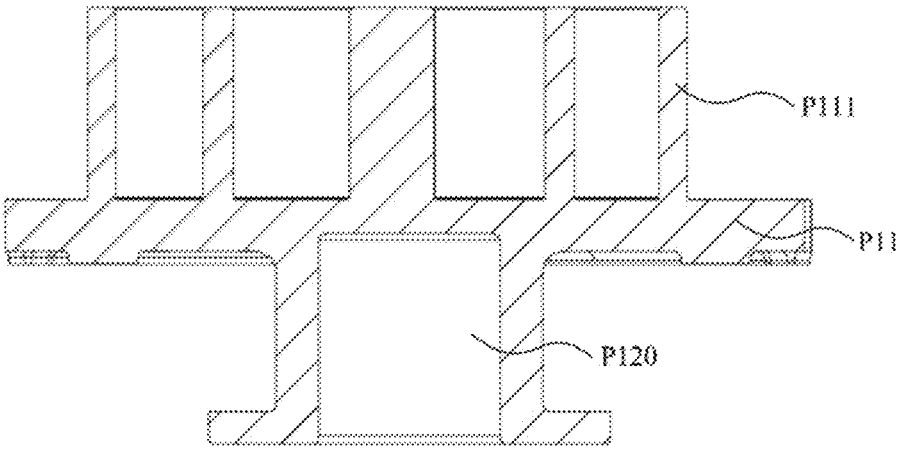
Figure 1D PRIOR ART

First, referring to FIGS. 1A, 1B, 1C and 1D, an orbiting scroll apparatus P1 for a scroll compressor in the related technology is illustrated, wherein FIG. 1A shows a perspective view of the orbiting scroll apparatus P1, FIG. 1B shows a side view of the orbiting scroll apparatus P1, FIG. 1C shows a cross-sectional view of the orbiting scroll apparatus P1 taken along the section line I-I in FIG. 1B, and FIG. 1D shows a longitudinal sectional view of the orbiting scroll apparatus P1 taken along the section line II-II in FIG. 1C. As shown, the orbiting scroll apparatus P1 includes: an orbiting scroll end plate P11, an orbiting scroll vane P111 provided on a side surface of the orbiting scroll end plate P11; and a hub P12, which has a cylindrical opening P120 for engaging with a drive bearing of the scroll compressor. As described above, in order to adjust the centroid of the orbiting scroll apparatus P1 as close as possible to a center axis of the drive bearing of the scroll compressor, a centroid-adjusting recess P121 is provided on an outer surface of the hub P12. As described above, the centroid-adjusting recess P121 in the related technology is generally formed by casting during the casting process of the orbiting scroll apparatus P1. As can be seen from the figures, the centroid-adjusting recess P121 is generally a polyhedron with a complicated shape. Therefore, the cost of manufacturing the orbiting scroll apparatus having such centroid-adjusting recess with this configuration by casting is relatively high. Moreover, this cast-formed centroid-adjusting recess with a complicated shape has higher requirements on the process, has certain limitations in centroid adjustment, and can hardly meet the requirements for flexible and precise adjustment of the centroid of the orbiting scroll apparatus according to the requirements of dynamic balance for different compressors in the later stage.

In contrast, the orbiting scroll apparatus manufactured according to the method for manufacturing the orbiting scroll apparatus for a scroll compressor of the present application and the scroll compressor including the orbiting scroll apparatus solve the above problems.

Figure 2A:
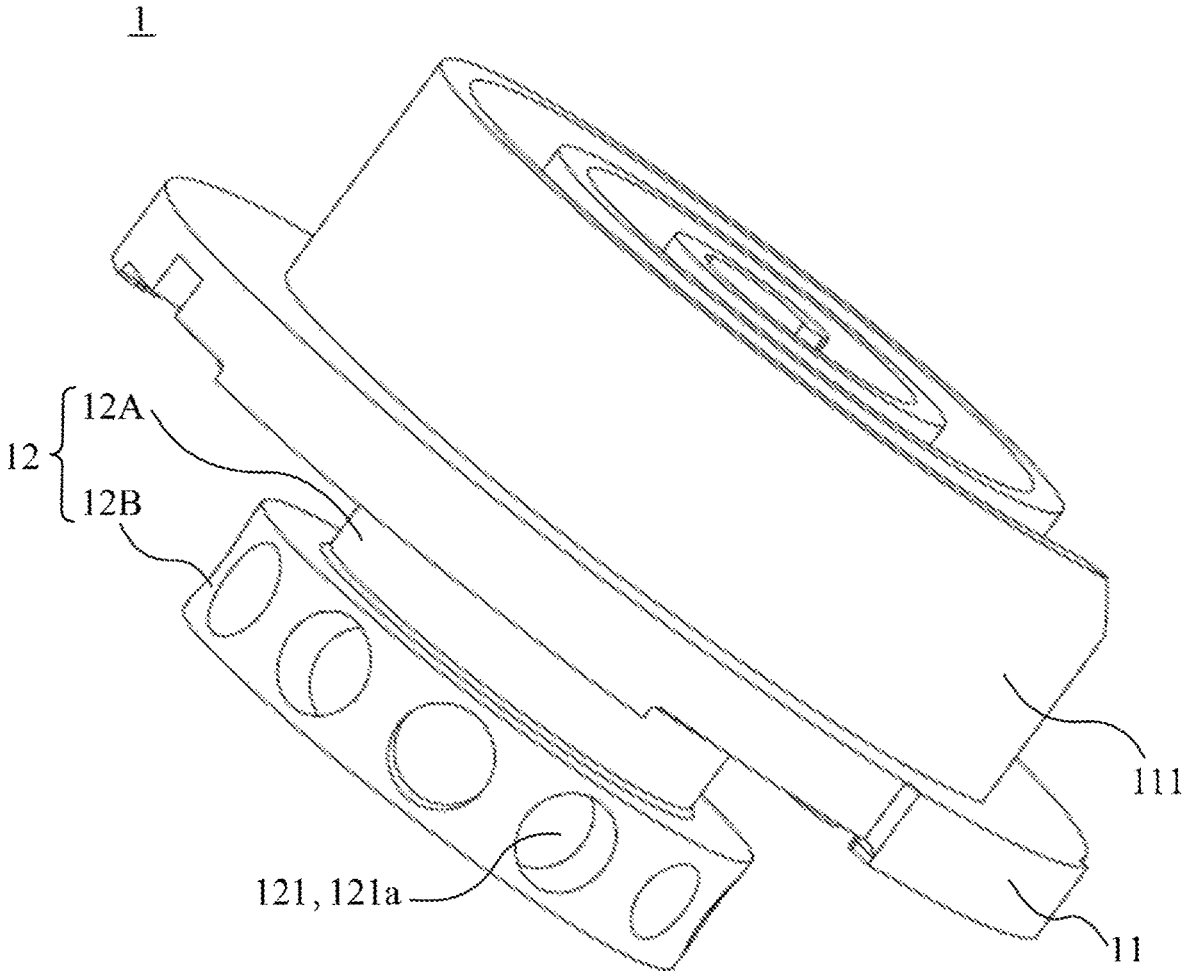
Figure 2B:
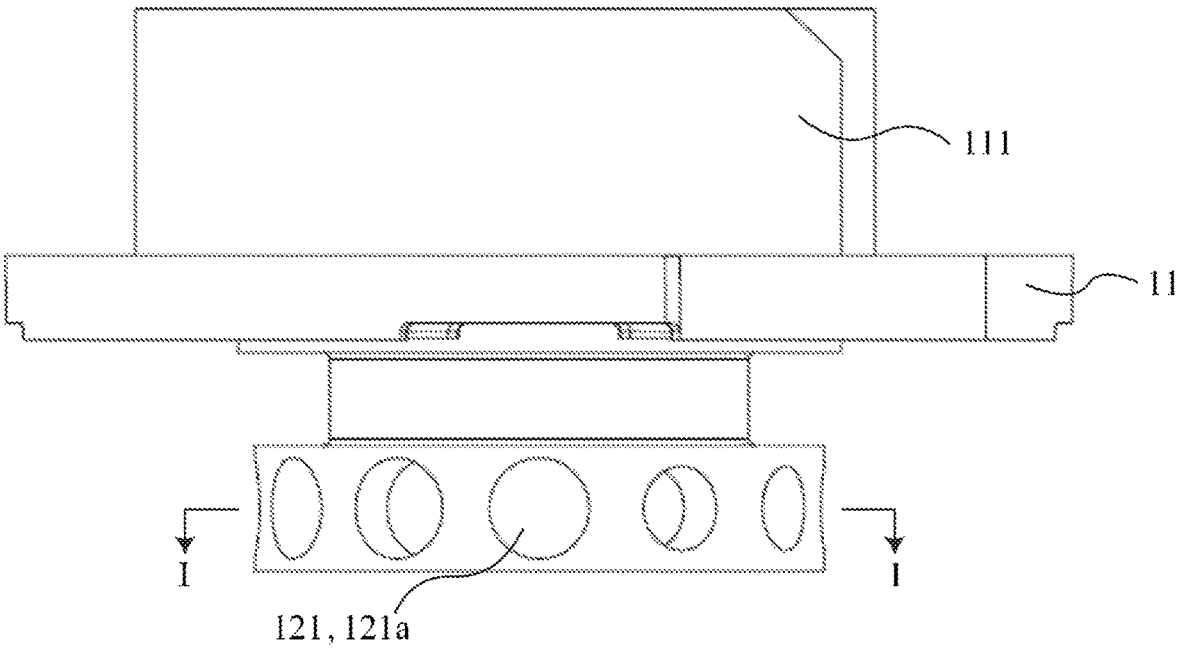
Figure 2C:
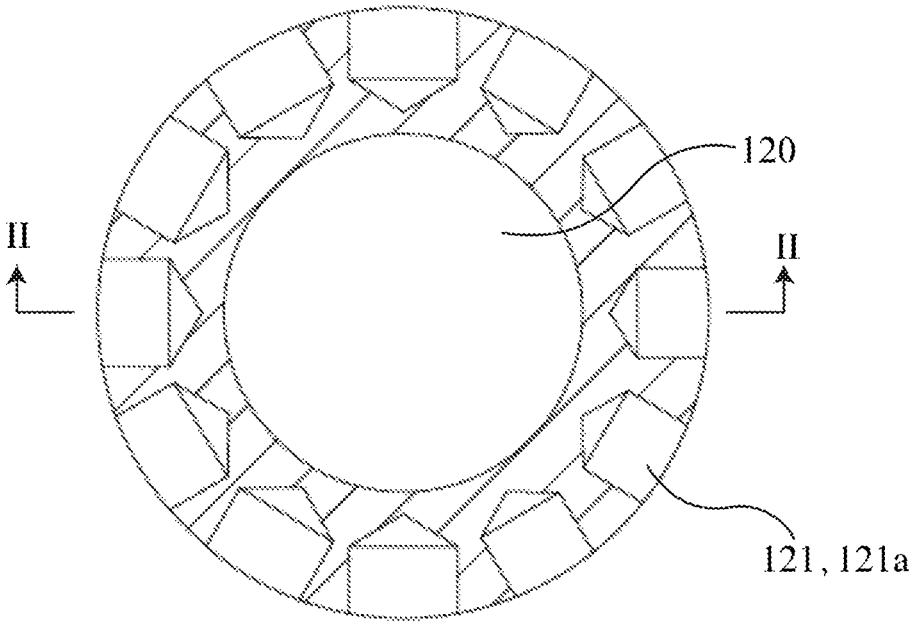

FIGS. 2A, 2B, 2C and 2D show an orbiting scroll apparatus 1 for a scroll compressor according to a first embodiment of the present application, wherein FIG. 2A shows a perspective view of the orbiting scroll apparatus 1, FIG. 2B shows a side view of the orbiting scroll apparatus 1, FIG. 2C P1 orbiting scroll apparatus in related technology;
P11 orbiting scroll end plate in related technology;
P111 orbiting scroll vane in related technology;
P12 hub in related technology;
P120 cylindrical opening in related technology;
P121 centroid-adjusting recess in related technology;

| | | |
|---|---|---|
| 1 orbiting scroll apparatus; | 11 orbiting scroll end plate; | |
| 111 orbiting scroll vane; | 12 hub; | |
| 120 cylindrical opening; | 121 at least one centroid-adjusting recess; | |
| 12A first cylindrical portion; | 12B second cylindrical portion; | |
| 121a at least one hole; | 121b, 121b' at least one groove; | |
| I-I section line; | II-II section line; | 10 scroll compressor. |

DETAILED DESCRIPTION OF THE EMBODIMENTS

Figure 2D:
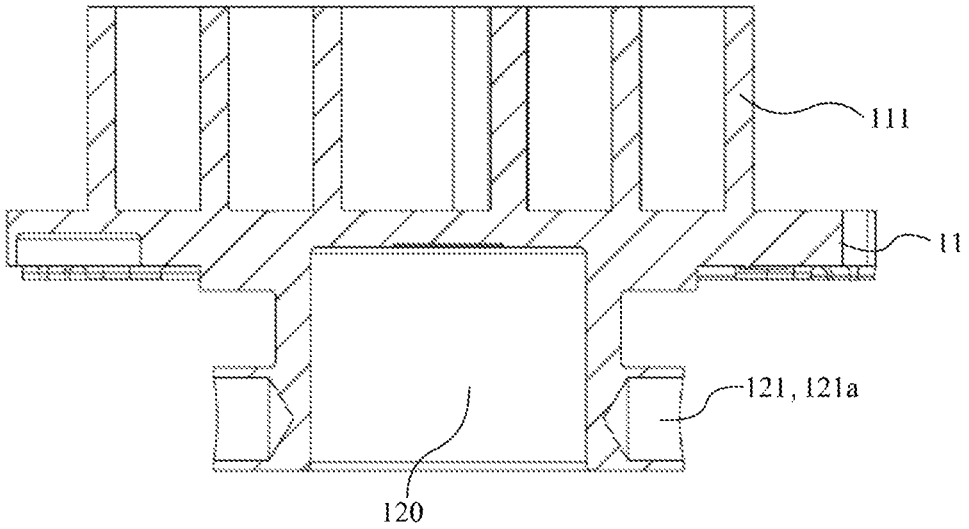

The present application relates to an orbiting scroll apparatus for a scroll compressor. Exemplary embodiments of shows a cross-sectional view of the orbiting scroll apparatus 1 taken along the section line I-I in FIG. 2B, and FIG. 2D shows a longitudinal sectional view of the orbiting scroll apparatus 1 taken along the section line II-II in FIG. 2C. As shown, the orbiting scroll apparatus 1 for a scroll compressor according to the first embodiment of the present application includes: an orbiting scroll end plate 11; an orbiting scroll vane 111 formed on a first side surface of the orbiting scroll end plate 11; and a hub 12, which is arranged on a second side surface of the orbiting scroll end plate 11 opposite to the first side surface and has a cylindrical opening 120 for engaging a drive bearing (not shown) of the scroll compressor. The hub 12 is composed of a first cylindrical portion 12A and a second cylindrical portion 12B which have different outer diameters. The first cylindrical portion 12A integrally and vertically extends from the orbiting scroll end plate 11. The outer diameter of the second cylindrical portion 12B is larger than the outer diameter of the first cylindrical portion 12A, and the second cylindrical portion 12B extends vertically from one end of the first cylindrical portion 12A while the second cylindrical portion 12B is concentric and integral with the first cylindrical portion 12A, wherein, at least one centroid-adjusting recess 121 formed by machining is provided, the at least one centroid-adjusting recess 121 may be provided at any position on the hub 12, and may be provided in any different shapes. In the first embodiment of the present application, as shown in the figures, the at least one centroid-adjusting recess 121 is located on an outer surface of the second cylindrical portion 12B of the hub 12, and the at least one centroid-adjusting recess 121 is machined into multiple holes 121*a* separated from each other, as clearly shown in FIG. 2C. The multiple holes 121*a* may have different hole diameters and hole depths, and may be spaced at different intervals to meet different requirements for centroid adjustment. The hole may be formed by any hole processing method known in the prior art, such as by drilling, reaming, boring, broaching, and the like, which is not particularly limited.

It should be understood that although the holes shown in the figures are spaced apart from each other, the actual application is not limited to this. Instead, multiple holes may be continuously processed on the surface of the hub 12 according to the requirements of the centroid adjustment in a manner that these holes are in communicating with each other.

Figure 3A:
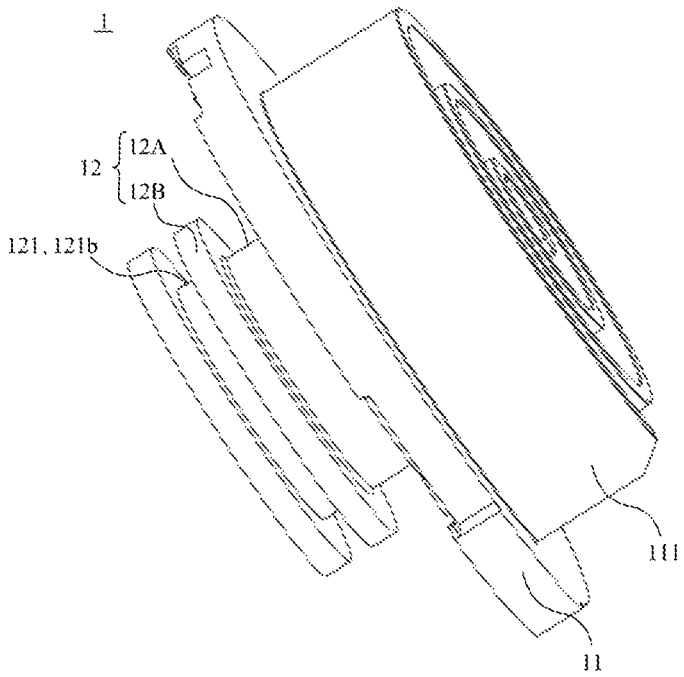
Figure 3B:
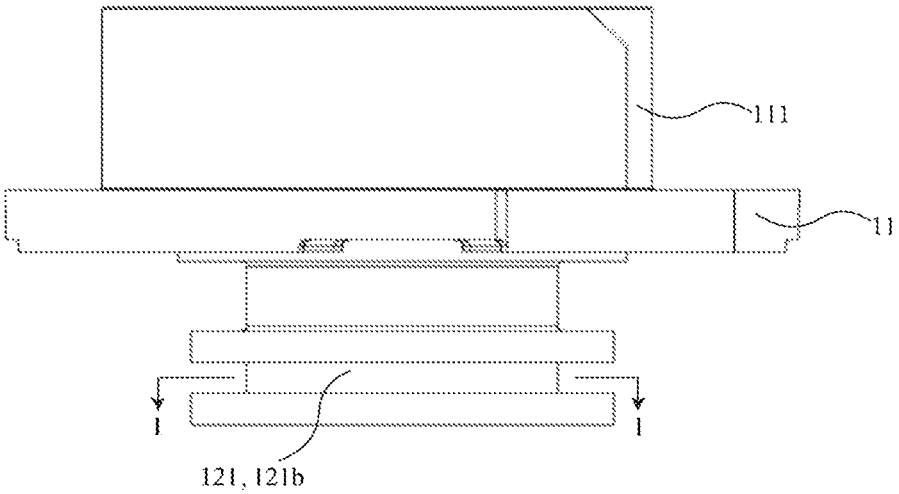
Figure 3C:
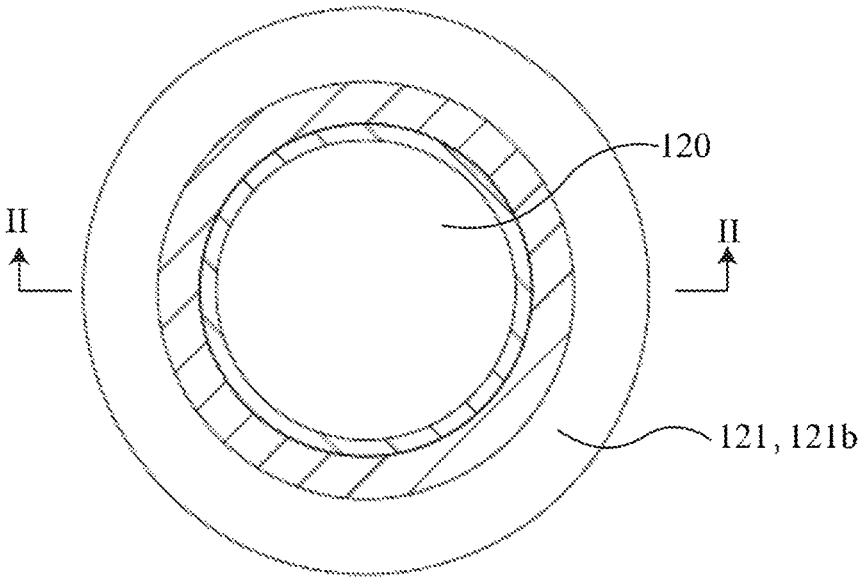
Figure 3D:
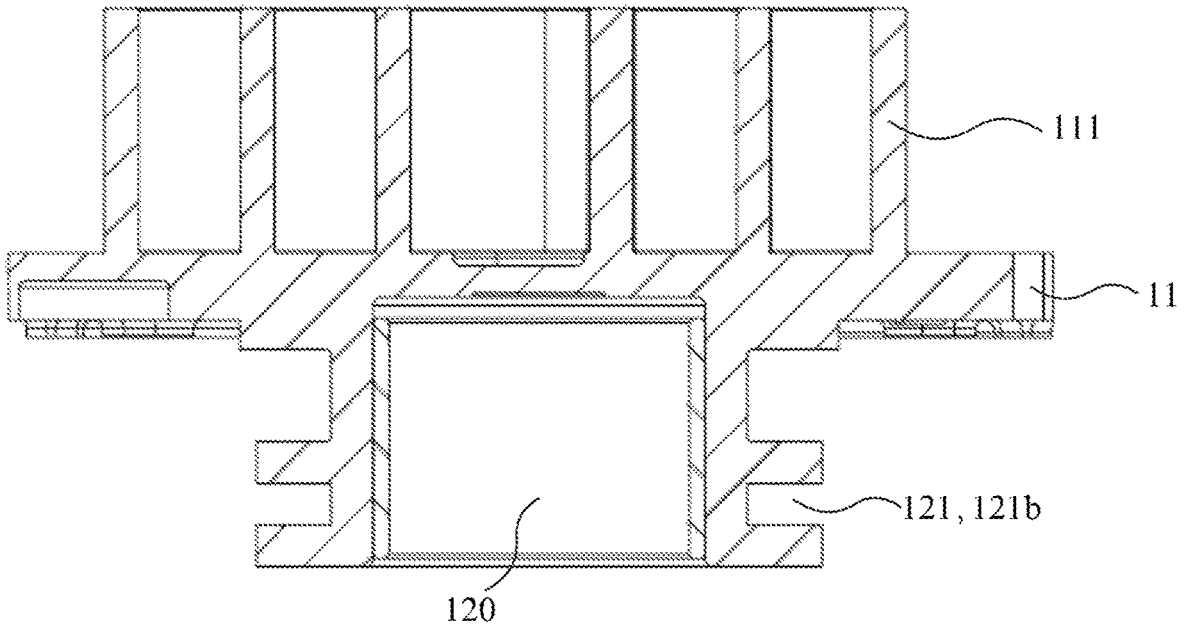

FIGS. 3A, 3B, 3C and 3D show the orbiting scroll apparatus 1 for a scroll compressor according to a second embodiment of the present application, wherein FIG. 3A shows a perspective view of the orbiting scroll apparatus 1, FIG. 3B shows a side view of the orbiting scroll apparatus 1, FIG. 3C shows a cross-sectional view of the orbiting scroll apparatus 1 taken along the section line I-I in FIG. 3B, and FIG. 3D shows a longitudinal sectional view of the orbiting scroll apparatus 1 taken along the section line II-II in FIG. 3C. As shown in the figures, the orbiting scroll apparatus 1 for a scroll compressor according to the second embodiment of the present application has a similar structure to the orbiting scroll apparatus 1 for a scroll compressor according to the first embodiment of the present application. The difference lies in that, in the orbiting scroll apparatus 1 for a scroll compressor according to the second embodiment of the present application, the at least one centroid-adjusting recess 121 is machined into one groove 121*b*, and, as shown in the figures, the groove 121*b* is an annular groove formed along the outer surface of the second cylindrical portion 12B of the hub 12 in a circumferential direction of the second cylindrical portion 12B, and the groove 121*b* has a constant opening width and a constant groove depth, that is, as can be seen from FIGS. 3C and 3D, an inner circumferential edge of the groove 121*b* is circular and is concentric with the cylindrical opening 120 of the hub 12. The groove may be formed by various suitable processing methods known in the art.

It is clear that, more than one groove may be provided, and these grooves may not be continuous loops, but may extend in any direction to form arcs or strips having different lengths, and these grooves may have different and varying opening widths and/or groove depths as needed, as in the third embodiment which will be described in detail below.

Figure 4A:
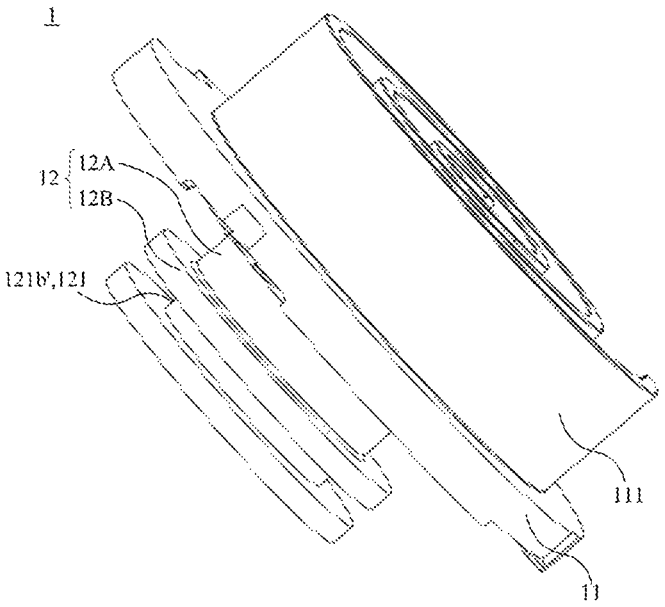
Figure 4B:
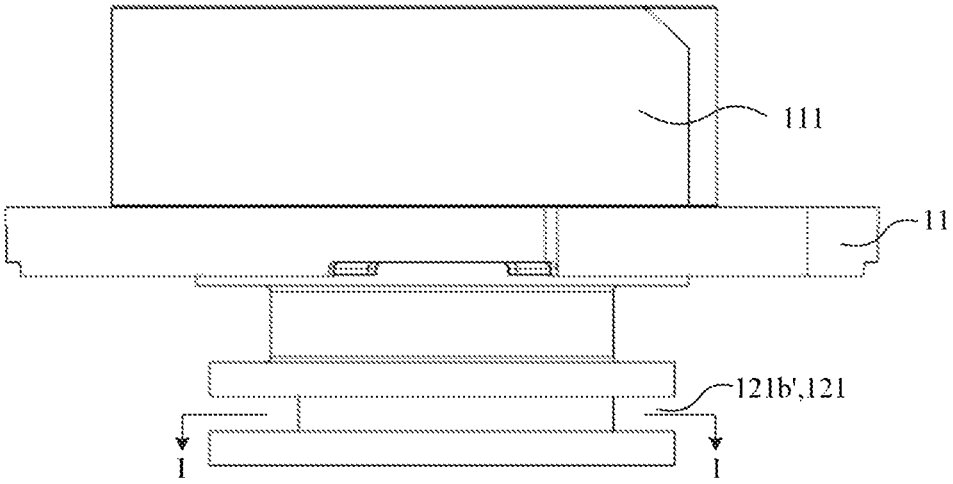
Figure 4C:
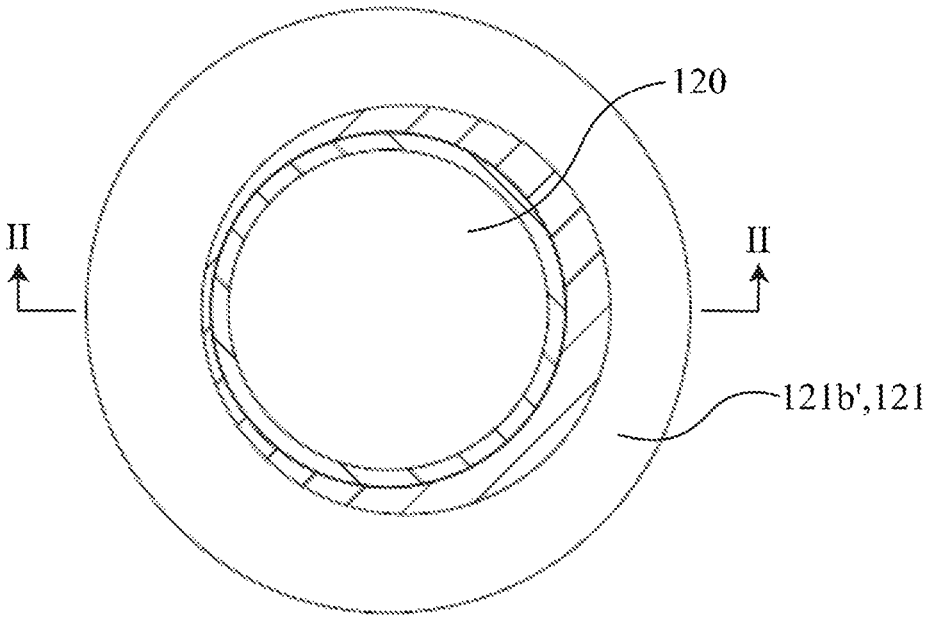
Figure 4D:
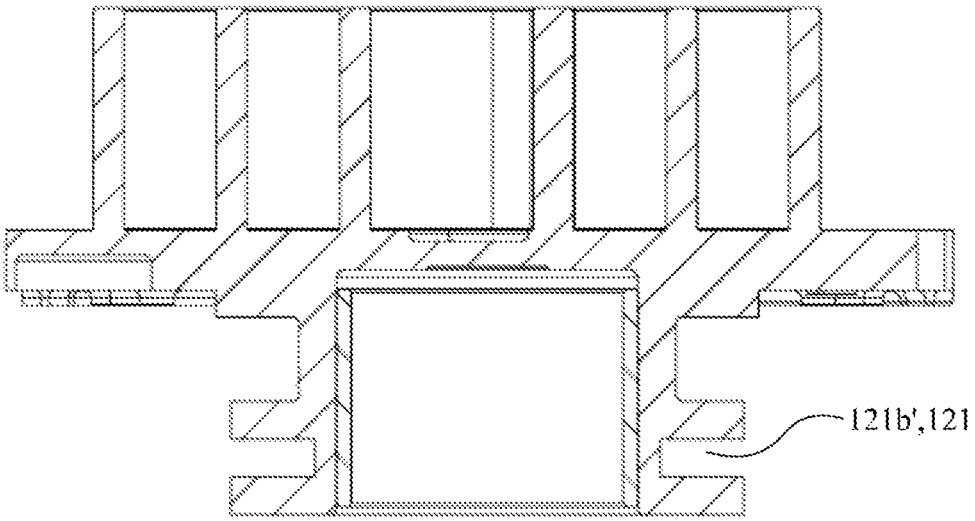

FIGS. 4A, 4B, 4C and 4D show the orbiting scroll apparatus 1 for a scroll compressor according to a third embodiment of the present application, wherein FIG. 4A shows a perspective view of the orbiting scroll apparatus 1, FIG. 4B shows a side view of the orbiting scroll apparatus 1, FIG. 4C shows a cross-sectional view of the orbiting scroll apparatus 1 taken along the section line I-I in FIG. 4B, and FIG. 4D shows a longitudinal sectional view of the orbiting scroll apparatus 1 taken along the section line II-II in FIG. 4C. As shown in the figures, the orbiting scroll apparatus 1 for a scroll compressor according to the third embodiment of the present application has a similar structure to the orbiting scroll apparatus 1 for a scroll compressor according to the second embodiment of the present application. The difference lies in that, in the orbiting scroll apparatus 1 for a scroll compressor according to the third embodiment of the present application, the at least one centroid-adjusting recess 121 is machined into one groove 121*b*', and, as shown in the figures, the groove 121*b*' is an annular groove formed along the outer surface of the second cylindrical portion 12B of the hub 12 in the circumferential direction of the second cylindrical portion 12B, and the groove 121*b*' has a varying groove depth, that is, as can be seen from FIGS. 4C and 4D, an inner circumferential edge of the groove 121*b*' is oval and is eccentric with respect to a center of the cylindrical opening 120 of the hub 12. Such a groove 121*b*' having a varying groove depth is formed by removing materials of different mass at different positions along the second cylindrical portion 12B of the hub 12, which thereby plays a role of adjusting the position of the centroid.

It should be noted that the present application is not limited to the above first, second, and third embodiments, and those skilled in the art may easily come up with any combination of the above embodiments to form a new embodiment.

Figure 5A:
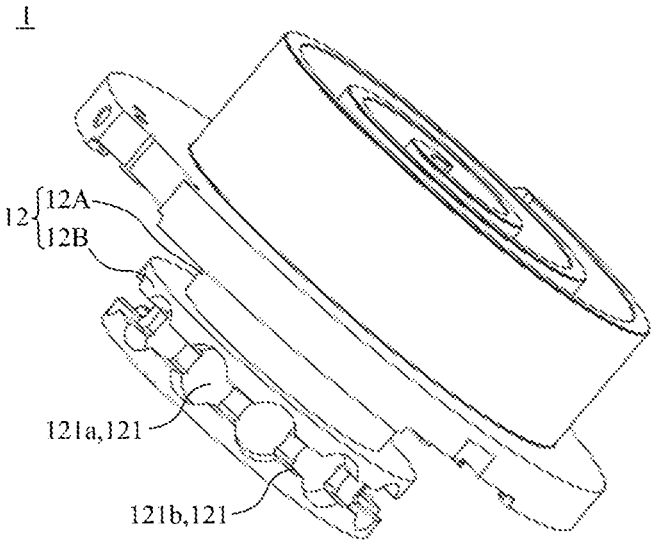
Figure 5B:
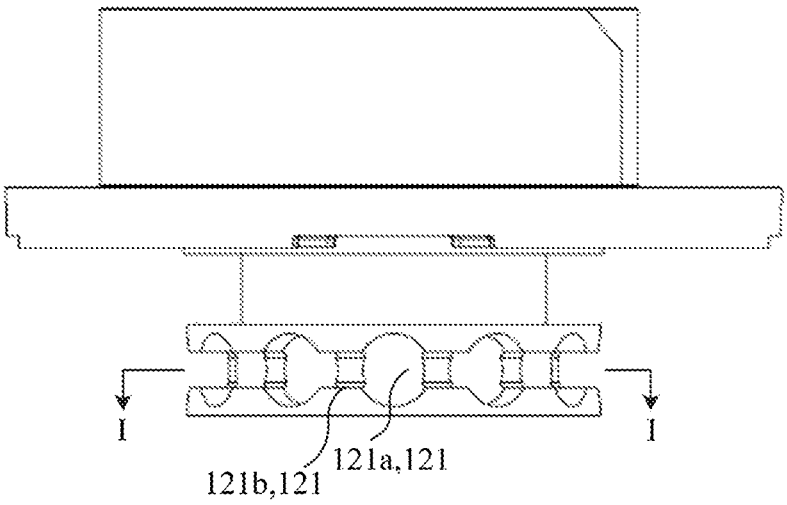
Figure 5C:
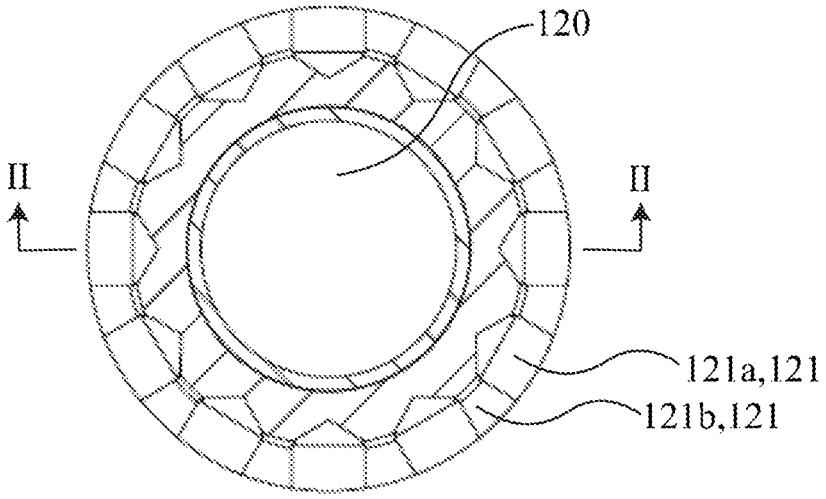
Figure 5D:
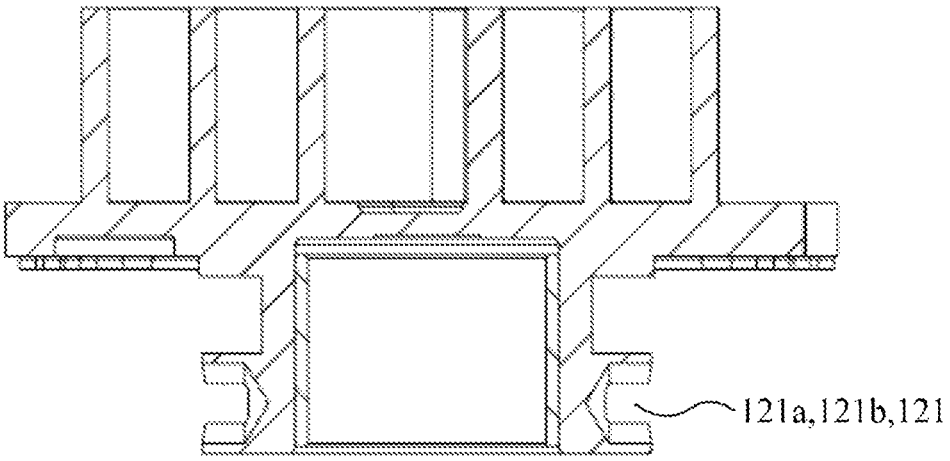

FIGS. 5A, 5B, 5C and 5D show the orbiting scroll apparatus 1 for a scroll compressor according to a forth embodiment of the present application, wherein FIG. 5A shows a perspective view of the orbiting scroll apparatus 1, FIG. 5B shows a side view of the orbiting scroll apparatus 1, FIG. 5C shows a cross-sectional view of the orbiting scroll apparatus 1 taken along the section line I-I in FIG. 5B, and FIG. 5D shows a longitudinal sectional view of the orbiting scroll apparatus 1 taken along the section line II-II in FIG. 5C. As shown, the orbiting scroll apparatus 1 for a scroll compressor according to the fourth embodiment of the present application is a combination of the first embodiment and the second embodiment, that is, as shown in the figures, in the orbiting scroll apparatus 1 for a scroll compressor according to the fourth embodiment of the present application, the at least one centroid-adjusting recess 121 is machined into a combination of the multiple mutually-separated holes 121*a* as shown in the first embodiment and the groove 121*b* as shown in the second embodiment. Specifically, as shown in FIGS. 5A, 5B, and 5C, the multiple mutually-separated holes 121*a* and the groove 121*b* partially overlap, that is, the groove 121*b* penetrates through the multiple mutually-separated holes 121*a* and communicates the multiple mutually-separated holes 121*a*. This embodiment actually firstly implements a centroid-adjusting recess (such as one of the multiple mutually-separated holes 121*a* and the groove 121*b*), and then further implements another centroid-adjusting recess (such as the other of the multiple mutually-separated holes 121*a* and the groove 121*b*) to further adjust the centroid and/or reduce weight.

Figure 6A:
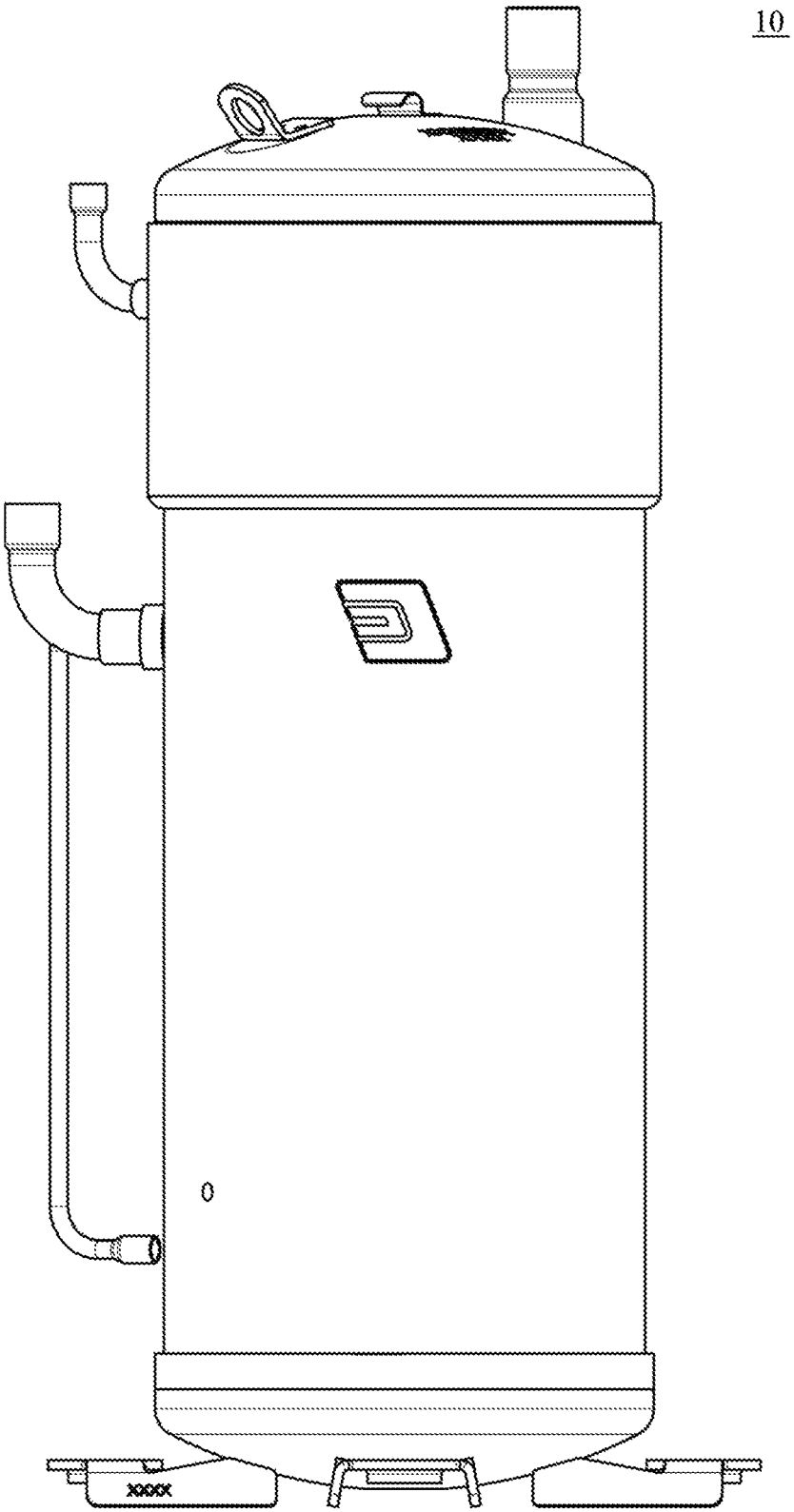
FIG. 6A shows a scroll compressor including the above orbiting scroll apparatus.
Figure 6B:
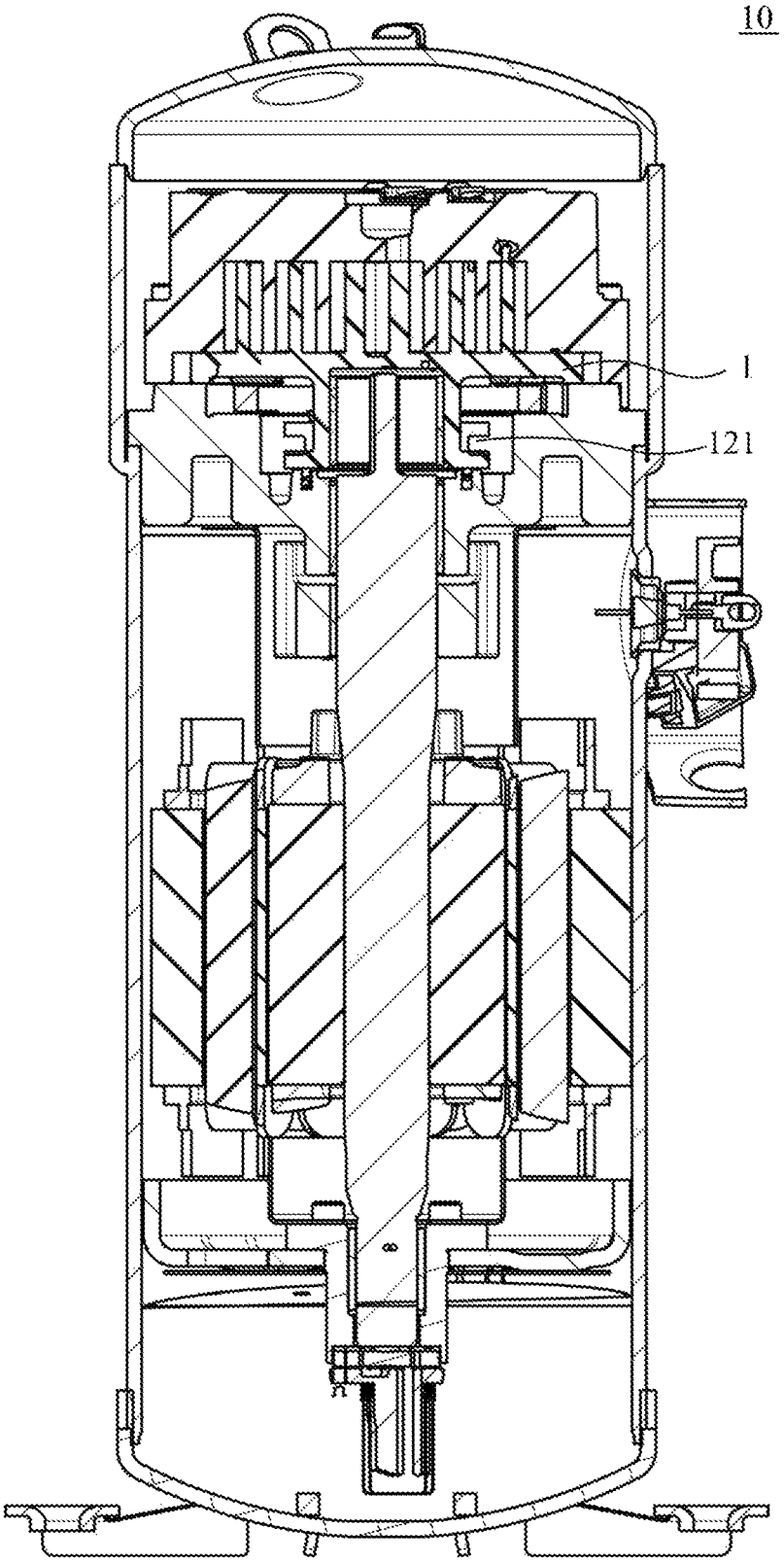
FIG. 6B shows a longitudinal sectional view of the scroll compressor including the above orbiting scroll apparatus in FIG. 6A.

According to another aspect of the present application, FIG. 6 shows a scroll compressor 10 including the above orbiting scroll apparatus 1.

Clearly, by combining different embodiments in different ways or modifying the embodiments, various different embodiments may be further obtained.

Preferred embodiments of the orbiting scroll apparatus for a scroll compressor according to the present application have been described above in conjunction with specific embodiments. It can be understood that, the above description is merely exemplary rather than restrictive, and those skilled in the art can conceive various variations and modifications without departing from the scope of the present application with reference to the above description. These variations and modifications shall still fall in the protection scope of the present application.

The invention claimed is:

1. An orbiting scroll apparatus for a scroll compressor, comprising:

an orbiting scroll end plate;

an orbiting scroll vane formed on a first side surface of the orbiting scroll end plate; and a hub, extending outward from a substantially central region of a second side surface of the orbiting scroll end plate opposite to the first side surface and having a cylindrical opening configured to receive a drive bearing;

wherein, the hub is provided with at least one centroid-adjusting recess, and wherein, the hub comprises a first cylindrical portion and a second cylindrical portion, the first cylindrical portion being integral with and vertically extending from the orbiting scroll end plate, an outer diameter of the second cylindrical portion being larger than an outer diameter of the first cylindrical portion, and the at least one centroid-adjusting recess being provided on the second cylindrical portion of the hub.

2. The orbiting scroll apparatus according to claim 1, wherein, the second cylindrical portion extends vertically from one end of the first cylindrical portion, and the second cylindrical portion is concentric and integral with the first cylindrical portion.

3. The orbiting scroll apparatus according to claim 1, wherein, the at least one centroid-adjusting recess is provided on an outer circumferential surface of the second cylindrical portion.

4. The orbiting scroll apparatus according to claim 3, wherein, the at least one centroid-adjusting recess comprises at least two centroid-adjusting recesses provided at different positions, and the at least two centroid-adjusting recesses have at least one of a different shape and a different size.

5. The orbiting scroll apparatus according to claim 3, wherein, the at least one centroid-adjusting recess comprises at least one of at least one hole and at least one groove.

6. The orbiting scroll apparatus according to claim 5, wherein, the at least one hole comprises at least two holes provided at different positions, and the at least two holes have at least one of a different diameter and a different depth.

7. The orbiting scroll apparatus according to claim 5, wherein, the at least one groove comprises at least two grooves provided at different positions, the at least two grooves have at least one of a different length, a different opening width, and a different depth, and the at least two grooves extend either circumferentially or axially.

8. The orbiting scroll apparatus according to claim 5, wherein, each of the at least one groove extends along an outer surface of the hub and along a circumferential direction of the second cylindrical portion with at least one of a constant opening width and a constant depth to form a ring shape.

9. The orbiting scroll apparatus according to claim 5, wherein, each of the at least one groove extends along an outer surface of the hub and along a circumferential direction of the second cylindrical portion with at least one of a varying opening width and a varying depth to form a ring shape.

10. The orbiting scroll apparatus according to claim 5, wherein, the at least one hole and the at least one groove are configured to at least partially overlap each other.

11. The orbiting scroll apparatus according to claim 1, wherein, the at least one centroid-adjusting recess is formed by machining.

12. The orbiting scroll apparatus according to claim 11, wherein, the machining comprises at least one of drilling, turning and milling.

13. A scroll compressor comprising an orbiting scroll apparatus according to claim 1.

14. A method for manufacturing an orbiting scroll apparatus for a scroll compressor, comprising the following steps:

casting the orbiting scroll apparatus so that the orbiting scroll apparatus comprises: an orbiting scroll end plate; an orbiting scroll vane formed on a first side surface of the orbiting scroll end plate; and a hub, extending outward from a substantially central region of a second side surface of the orbiting scroll end plate opposite to the first side surface and having a cylindrical opening configured to receive a drive bearing; and providing at least one centroid-adjusting recess on the hub to adjust the centroid of the orbiting scroll apparatus to the center axis of the drive bearing, wherein, the hub comprises a first cylindrical portion and a second cylindrical portion, the first cylindrical portion being integral with and vertically extending from the orbiting scroll end plate, an outer diameter of the second cylindrical portion is larger than an outer diameter of the first cylindrical portion, and the at least one centroid-adjusting recess is provided on the second cylindrical portion of the hub.

15. The method according to claim 14, wherein, the second cylindrical portion extends vertically from one end of the first cylindrical portion while the second cylindrical portion is concentric and integral with the first cylindrical portion.

16. The method according to claim 15, wherein, the at least one centroid-adjusting recess comprises at least two centroid-adjusting recesses provided at different positions, and the at least two centroid-adjusting recesses have at least one of a different shape and a different size.

17. The method according to claim 15, wherein, the at least one centroid-adjusting recess comprises at least one of at least one hole and at least one groove.

18. The method according to claim 14, wherein, the at least one centroid-adjusting recess is formed by machining.

19. The method according to claim 18, wherein, the machining comprises at least one of drilling, turning and milling.

* * * * *